United States Patent [19]

Shand et al.

[11] Patent Number: 4,754,266

[45] Date of Patent: Jun. 28, 1988

[54] TRAFFIC DIRECTOR

[76] Inventors: Kevin J. Shand, 483 Bahia Way, San Rafael, Calif. 94901; B. Anne Highfill, 394 Durant Way, Mill Valley, Calif. 94941

[21] Appl. No.: 1,171

[22] Filed: Jan. 7, 1987

[51] Int. Cl.[4] ..... G08B 7/06; G08B 17/00; G08B 19/00

[52] U.S. Cl. ..... 340/691; 340/309.4; 340/332; 340/521; 340/692

[58] Field of Search ..... 340/691, 692, 309.4, 340/332, 521, 331

[56] References Cited

U.S. PATENT DOCUMENTS 4,029,994 6/1977 Iwans ..... 340/945

4,453,222 6/1984 Goszyk ..... 340/521

FOREIGN PATENT DOCUMENTS 2463567 2/1981 France ..... 340/600

*Primary Examiner*—Glen R. Swann, III

*Attorney, Agent, or Firm*—Larry D. Johnson

[57] ABSTRACT

The traffic director of this invention is an improved fire detector and exit indicator that provides both audio and visual exit cues to the occupants of a burning or power-failed building or other occupied structure. A series of traffic director units are placed at various predetermined intervals along an appropriate escape route, and are mounted into the walls of the building at crawling height (approximately three feet above floor level). The independent units are either battery powered or are tied into the building's emergency backup power system. When a fire is detected by a given unit's smoke or heat sensors, or a power failure is detected by the unit's light sensor, that unit's front panel displays a lighted, moving arrow pointing towards the nearest building exit, and the unit's synthesized-voice audio system gives verbal directions to that exit. Each independent unit is programmable through a series of DIP switches that allow each unit to be modified to give the appropriate audio instructions regardless of where that unit is installed in the building. Being independent, each unit will reset and turn off after the sensed emergency situation has ended.

8 Claims, 2 Drawing Sheets

TRAFFIC DIRECTOR

BACKGROUND OF THE INVENTION

1. Field of the Invention

This invention relates generally to sensing and display equipment, and more specifically to fire detectors and emergency safety devices.

2. Description of the Prior Art

Fires and other emergencies can create critical escape problems for the occupants of buildings. For example, it can initially be difficult for an occupant to determine if a remote fire has even started, especially in a multi-story building. Once underway, however, such a fire can fill the rooms and hallways with smoke, making it then difficult for the occupants to find a safe exit.

Accordingly, numerous sensing and display devices have been developed to alert building occupants to such dangers, and assist them in their escape. For example, most modern building codes require prominent exit signs to be posted near all building exits. Other signs utilize a series of slightly raised "bumps" or other tactile reference to indicate exit direction in no-light conditions. These, of course, provide no fire alert or other warning, but at least they serve to generally identify an appropriate exit in an emergency. In addition, most buildings now incorporate fire detectors and smoke alarms as fixed, strategically-placed ceiling-mounted devices that emit a warning alarm when heat and/or combustion gasses are sensed. Some such devices also provide emergency lighting when activated. Unfortunately, the warning alarm is an alert only and provides no guidance to an exit, and the emergency lighting may be diffused or completely blocked out by dense smoke.

Other, more sophisticated systems provide a network of remote sensing devices in communication with a central monitoring unit. For example, in Topol et al. U.S. Pat. No. 4,531,114, when a fire is detected by one remote sensing device, and confirmed by another, the central unit can direct the remote devices to illuminate the building's exit lights and initiate speech-synthesized verbal exit instructions to the building occupants. However, such a system relies on a pair of remote warning devices to be activated, and on the central unit for control, and thus requires extensive, and costly, communication links. Even if the remote devices were to stand alone and operate independently, they would only serve to illuminate the building's exit locations, and would not provide any auditory support.

SUMMARY OF THE INVENTION

The traffic director of this invention is an improved fire detector and exit indicator that provides both audio and visual exit cues to the occupants of a burning or power-failed building or other occupied structure. A series of traffic director units are placed at various predetermined intervals along an appropriate escape route, and are mounted into the walls of the building at crawling height (approximately three feet above floor level). The independent units are either battery powered or are tied into the building's emergency backup power system. When a fire is detected by a given unit's smoke or heat sensors, or a power failure is detected by the unit's light sensor, that unit's front panel displays a lighted, moving arrow pointing towards the nearest building exit, and the unit's synthesized-voice audio system gives verbal directions to that exit. Each independent unit is programmable through a series of DIP switches that allow each unit to be modified to give the appropriate audio instructions regardless of where that unit is installed in the building. Being independent, each unit will reset and turn off after the sensed emergency situation has ended.

Each unit's audio system is capable of being independently programmed to produce the appropriate verbal instructions relative to the location of the nearest building exit, and repeat those instructions on a regular (e.g., fifteen seconds) basis. For example, a unit that is installed at the end of a closed corridor might be programmed to say "The exit is located fifty feet (or, "ten doors", or some other distance measurement) behind you". Where direction is critical, and potentially ambiguous, such as in the middle of a long corridor, the instructions can be more orientation-specific, and give the listener a point of reference, for example "If you hear this message in your left ear, proceed along this wall to the exit five doors down. If you hear this message in your right ear, turn around, and proceed . . .". In this way, the voice commands can clearly identify the intended escape route, even if the visual cues are not discernible.

Several other features are incorporated into the traffic director units to increase their usefulness. For example, the front panel arrow is highlighted or impregnated with glow-in-the-dark paint or other material, to enhance the arrow's visibility in a darkened corridor. In addition, each of the lights that make up the front panel's arrow are raised slightly from the panel itself, so that the lights form a tactile reference arrow as well. Furthermore, the lights themselves are illuminated in a time-delay sequence to give the impression that the arrow itself is moving in the direction it is pointing, thus further enhancing the visual effectiveness.

Thus, the traffic director units each provide a relatively compact, inexpensive, and unobtrusive safety device that is independent of the building's power, communications, and emergency exit signs and lighting, as well as the units being independent of each other. Accordingly, these units are equally suitable for original installation in new structures, as well as aftermarket applications in existing structures.

DETAILED DESCRIPTION OF A PREFERRED EMBODIMENT

Figure 1:
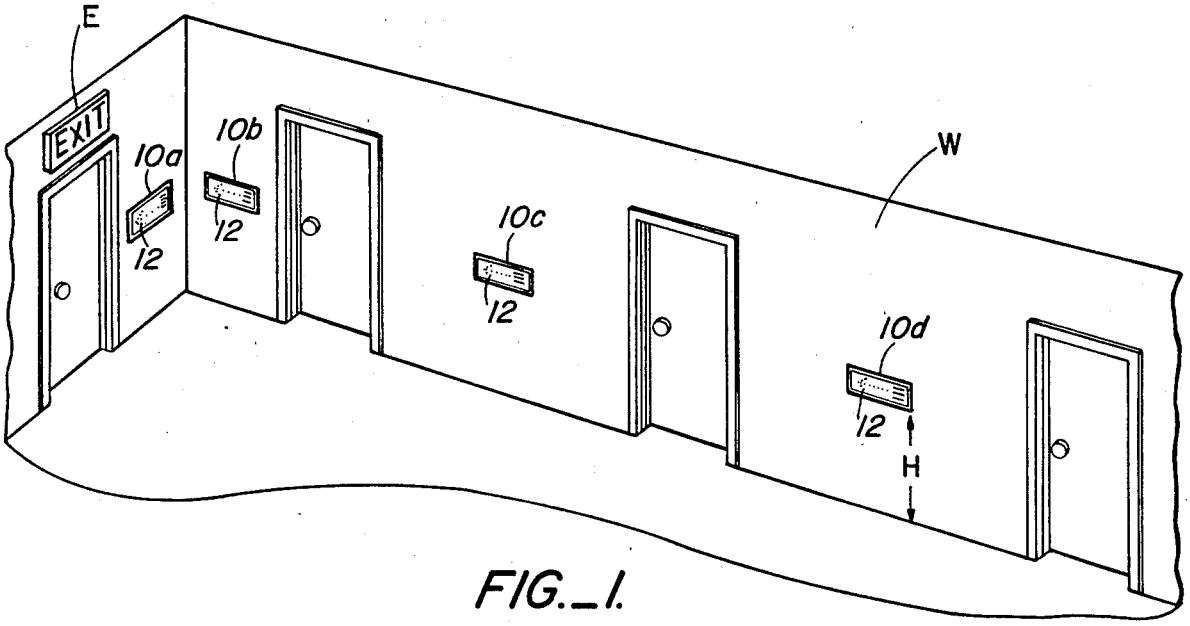
FIG. 1 is a perspective view of a series of traffic director units of this invention, installed and in place in the walls of a typical corridor.

FIG. 1 illustrates a series of traffic director units as installed in the walls of a corridor. Traffic director units 10*a–d* are placed in the wall W at an appropriate distance apart (e.g., ten feet) so that their visual and auditory exit cues will be seen and heard with little or no interruption by an individual travelling down the corridor. Of course, the volume of the verbal instructions given should be such that there is no interference or overlap between units. Each of the unit's lighted arrows 12 is oriented towards the exit E. To point the arrow in the other direction, the unit is simply turned over and oriented that way upon installation. The units can be recessed into the wall and flush-mounted, as shown, or surface mounted.

The traffic director units are installed at a "crawling height" H of approximately three feet above floor level. Such a height is appropriate so that the heat and smoke sensors are sufficiently sensitive to react to a fire, but still low enough to be visible to a building occupant either walking, crawling, or rolling in a wheelchair. In addition, since smoke tends to fill a room or corridor from the ceiling down, installation at such a height will render the units visible for a longer period than higher-mounted units.

Each of the traffic director units 10*a–d* can be independently programmed to deliver the appropriate auditory escape instructions. For example, unit 10*a* could be programmed to say "Exit here", while unit 10*b* could say "Exit around corner to left", unit 10*c* "Exit twenty feet to left", and so forth. Thus, the only things that are necessary upon installation of each independent unit are to orient the lighted arrow 12 in the appropriate direction, and program the appropriate verbal instructions.

Figure 2:
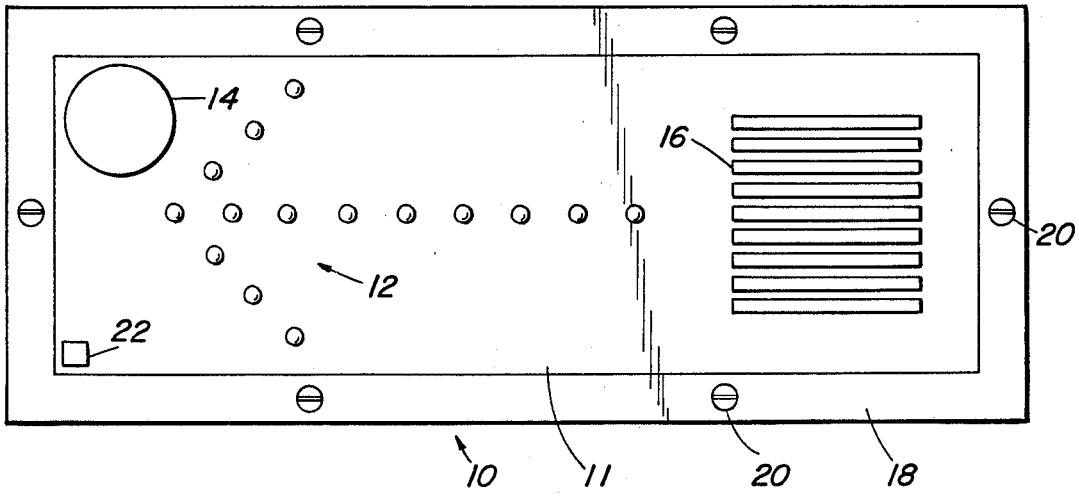
FIG. 2 is an elevated front view of a traffic director unit.

FIG. 2 is an elevated front view of a typical traffic director unit 10. Unit 10 includes front panel 11, lighted arrow 12, speaker 14, sensor air access vent 16, mounting flange 18, and screws 20. Battery level indicator 22 may be a separate "low battery" light, as shown, or the same function could be incorporated into one of the lights in lighted arrow 12.

Figure 3:
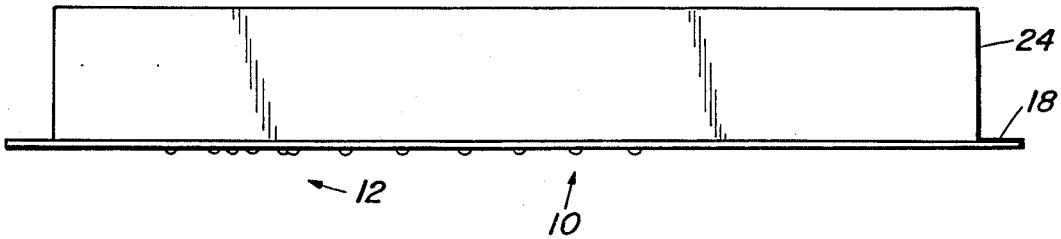
FIG. 3 is a top view of a traffic director unit.

FIG. 3 is a top view of a traffic director unit 10, showing flange 18 extending around case 24. This embodiment is thus appropriate for recessed installations, which is suitable for most applications. The slightly-raised features of lighted arrow 12 can also be seen in this view, enabling the arrow to serve as a tactile reference as well.

Figure 4:
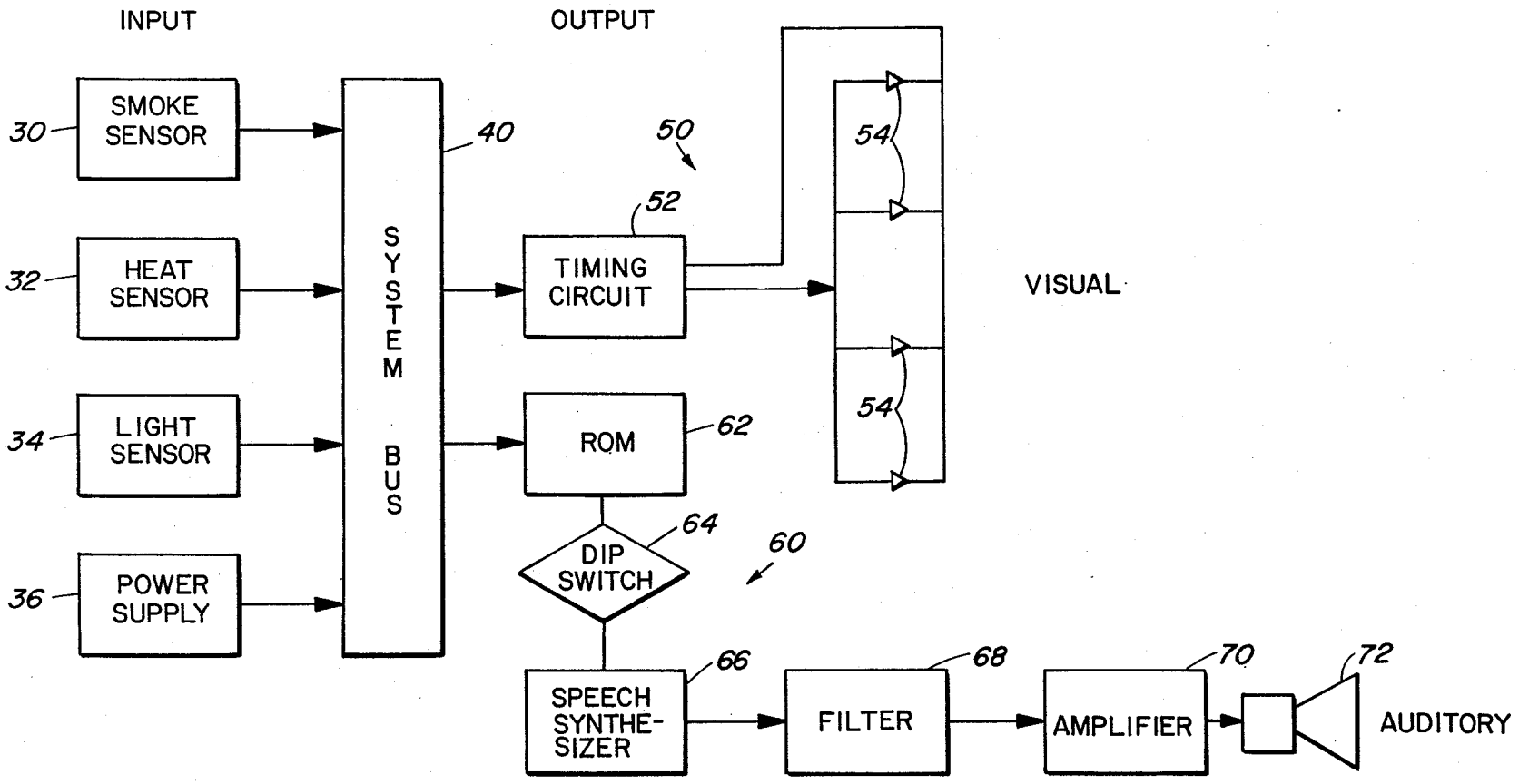
FIG. 4 is a block diagram of the input/output circuit of a traffic director unit.

FIG. 4 is a block diagram of the input/output circuit of a traffic director unit. The input devices include ionization smoke detector sensor 30, which can be replaced by an infrared beam diffraction smoke detector where radiation-containing devices are restricted or prohibited. Bimetal heat sensor 32 detects excessive heat, while photoelectric light sensor 34 detects a building power failure by the appurtenant loss of ambient light. All of these input devices can be adjusted to be more or less sensitive, as needed. Finally, power supply 36, preferably a lithium or other long-life battery, provides power to the system.

Signals from input devices 30, 32, and 34 are delivered by the system bus 40 to the visual output section 50 and auditory output section 60. Visual output 50 comprises timing circuit 52, which staggers the electrical signal to front panel arrow lights 54 so that the lights are illuminated in sequential order, and the lighted arrow that is displayed appears to "move" in the direction that it is pointing.

Auditory output section 60 comprises ROM (read only memory) unit 62 for storage of preprogrammed voice commands, and DIP switch 64 for manual selection of one of those various commands prior to installation. The mechanical voice itself is generated by speech synthesizer 66, with line noise eliminated by filter 68, then amplified by amplifier 70, and delivered through speaker 72.

While this invention has been described in connection with preferred embodiments thereof, it is obvious that modifications and changes therein may be made by those skilled in the art to which it pertains without departing from the spirit and scope of the invention. For example, the traffic director unit's compact nature and independent features make it suitable for installation in movie theaters, airplanes, mass transit vehicles, and the like. Accordingly, the scope of this invention is to be limited only by the appended claims.

What is claimed as invention is:

1. A traffic director system comprising:

smoke sensing means for detecting smoke and delivering a smoke danger signal when the detected smoke is above a predetermined level;

heat sensing means for detecting heat and delivering a heat danger signal when the detected heat is above a predetermined level;

visual direction means for producing a visual direction indication comprising a plurality of lights forming an arrow shape, said lights extending slightly above a front panel to form a tactile direction reference in said arrow shape;

auditory direction means for producing a direction-indicating vocal command;

circuit means for processing said smoke danger signal and said heat danger signal and activating said visual direction means and said auditory direction means when a danger signal is delivered; and independent power means for powering said system.

2. The traffic director of claim 1 including light sensing means for detecting light and delivering a loss-of-light danger signal when the detected light is below a predetermined level, and wherein said circuit means activates said visual direction means and said auditory direction means when said loss-of-light danger signal is delivered.

3. The traffic director of claim 2 wherein said light sensing means comprises a photoelectric light sensor.

4. The traffic director of claim 1 wherein said smoke sensing means comprises an ionization smoke detector.

5. The traffic director of claim 1 wherein said heat sensing means comprises a bimetallic heat sensor.

6. The traffic director of claim 1 wherein said circuit means includes a timing circuit to illuminate said lights in a sequential order.

7. The traffic director of claim 1 wherein said auditory direction means comprises memory means for storage of preprogrammed voice commands, switch means for selection of one of said commands, synthesizer means for generating mechanical speech, and speaker means for delivering said speech.

8. The traffic director of claim 1 wherein said power means comprises a self-contained battery, and including a low-battery indicator.

* * * * *